US007469893B2

(12) United States Patent
Yamada

(10) Patent No.: US 7,469,893 B2
(45) Date of Patent: Dec. 30, 2008

(54) SHEET LOADING DEVICE AND IMAGE FORMING APPARATUS

(75) Inventor: Masayuki Yamada, Osaka (JP)

(73) Assignee: Kyocera Mita Corporation (JP)

( * ) Notice: Subject to any disclaimer, the term of this patent is extended or adjusted under 35 U.S.C. 154(b) by 204 days.

(21) Appl. No.: 11/638,723

(22) Filed: Dec. 14, 2006

(65) Prior Publication Data

US 2007/0138737 A1 Jun. 21, 2007

(30) Foreign Application Priority Data

Dec. 16, 2005 (JP) ..... 2005-362805

(51) Int. Cl.
*B65H 1/00* (2006.01)

(52) U.S. Cl. ..... 271/171

(58) Field of Classification Search ..... 271/171, 271/145

See application file for complete search history.

(56) References Cited

U.S. PATENT DOCUMENTS

| | | | | |
|---|---|---|---|---|
| 5,975,517 | A * | 11/1999 | Lim | 271/117 |
| 6,332,610 | B1 * | 12/2001 | Hiura | 271/171 |
| 6,805,345 | B2 * | 10/2004 | Furukawa | 271/171 |
| 2003/0184007 | A1 * | 10/2003 | Furukawa | 271/171 |
| 2005/0051947 | A1 * | 3/2005 | Furukawa | 271/171 |
| 2005/0151315 | A1 * | 7/2005 | Yokoi | 271/145 |
| 2006/0113725 | A1 * | 6/2006 | Ito | 271/171 |
| 2006/0180998 | A1 * | 8/2006 | Lee et al. | 271/171 |
| 2007/0114713 | A1 * | 5/2007 | Yonemoto | 271/171 |

FOREIGN PATENT DOCUMENTS

| | | | |
|---|---|---|---|
| JP | 04350024 A | * | 12/1992 |
| JP | 2000-153925 | | 6/2000 |

* cited by examiner

*Primary Examiner*—Kaitlin S Joerger
(74) *Attorney, Agent, or Firm*—Gerald E. Hespos; Anthony J. Casella

(57) ABSTRACT

Disclosed is a sheet loading device, which comprises a sheet tray adapted to place thereon a sheet stack consisting of a plurality of stacked sheets, a pair of side fences disposed on the side on a top surface of the sheet tray to sandwich the sheet stack therebetween in a direction orthogonal to a sheet loading direction, a pair of racks attached to respective ones of the pair of side fences and disposed on the side of a bottom surface of the sheet tray to extend in mutually opposed directions of the pair of side fences, and a pinion adapted to be rotated about a pinion shaft penetrating the sheet tray and engaged with the racks. The pinion has a first surface opposite to the bottom surface of the sheet tray, and a second surface located on the opposite side of the first surface and provided coaxially with a flange having a diameter greater than that of an engaged portion of the pinion. Each of the racks has a concave portion formed in a bottom surface of an end thereof on the side of the associated side fence and adapted to allow the flange to be fitted therein.

14 Claims, 5 Drawing Sheets

+X
-X
+Y
-Y
IVB
IVD

SHEET LOADING DEVICE AND IMAGE FORMING APPARATUS

BACKGROUND OF THE INVENTION

1. Field of the Invention

The present invention relates to a sheet loading device having a sheet tray for placing thereon a stack of sheets (sheet stack) to be fed to a given apparatus, and an image forming apparatus using the sheet loading device.

2. Description of the Background Art

Heretofore, there has been known a sheet loading device as disclosed in Japanese Patent Laid-Open Publication No. 2000-153925. This sheet loading device is used for allowing a stack of sheets stored on a sheet loading tray of a sheet cassette detachably attached to an image forming apparatus to be taken out one-by-one and fed to the image forming apparatus. The sheet loading device includes a pair of side fences which are disposed opposed to each other in a sheet-width or lateral direction to uniformly place a sheet stack on the sheet loading tray and adapted to be moved in positive and negative directions so as to change a distance therebetween in conformity to a sheet size.

The side fences are provided, respectively, with a pair of racks which penetrate the sheet loading tray and extend along a bottom surface of the sheet loading tray in mutually opposed directions of the side fences. Further, a pinion is attached to a central region of the bottom surface of the sheet loading tray in such a manner as to be engaged with the racks. Thus, when one of the side fences is laterally moved by a certain distance, the other side fence is moved in an opposite direction by the same distance through the rack of the moved side fence, the pinion and the rack of the other side fence. This provides an easy and convenient manner of positioning the pair of side fences in conformity to a sheet size.

In this type of sheet loading device, when a sheet stack is placed between the side fences while positioning the side fences and then a given sheet load mechanism is driven to load sheets one-by-one from the sheet stack, a lateral distance between the side fences is likely to be increased due to pressure of the sheets caused by a force applied from the sheet load mechanism. The increased lateral distance between the side fences is liable to cause an undesirable situation where the sheet is fed in an oblique posture without being adequately positioned. This tendency becomes prominent when respective axes of a pair of feed rollers are not maintained parallel to each other. The sheet fed in an oblique posture makes it difficult to properly perform an image forming processing therefor.

With a view to eliminate the above disadvantage, in the sheet loading device disclosed in the above patent publication an elastic member is provided in each of the racks in such a manner as to come into press contact with the sheet loading tray in an elastically deformed state so as to generate a frictional force for preventing each of the racks from being lightly moved.

In exchange for this advantage this sheet loading device is required to attach the elastic member to each of the racks. This leads to increases in the number of components and in a process time for assembling thereof, resulting in rising of production costs.

SUMMARY OF THE INVENTION

It is an object of the present invention to provide a sheet loading device capable of stably setting a pair of side fences at intended positions while suppressing addition of a new component and increase in assembling process time, and an image forming apparatus using the sheet loading device.

In order to achieve the above object, according to a first aspect of the present invention, there is provided a sheet loading device which comprises a sheet tray adapted to place thereon a sheet stack consisting of a plurality of stacked sheets, a pair of side fences disposed on the side on a top surface of the sheet tray to sandwich the sheet stack therebetween in a direction orthogonal to a sheet loading direction, a pair of racks attached to respective ones of the pair of side fences and disposed on the side of a bottom surface of the sheet tray to extend in mutually opposed directions of the pair of side fences, and a pinion adapted to be rotated about a pinion shaft penetrating the sheet tray and engaged with the racks. The pinion has a first surface opposite to the bottom surface of the sheet tray, and a second surface located on the opposite side of the first surface and provided coaxially with a flange having a diameter greater than that of an engaged portion of the pinion. Further, each of the racks has a concave portion formed in a bottom surface of an end thereof on the side of the associated side fence and adapted to allow the flange to be fitted therein.

According a second aspect of the present invention, there is provided an image forming apparatus which comprises an apparatus body for reading image data from a sheet and performing an image forming processing based on said read image data, and a sheet loading device for loading a sheet as a read target tossed apparatus body. The sheet loading device has the above features of the sheet loading device according to the first aspect of the present invention.

BRIEF DESCRIPTION OF THE DRAWINGS

FIGS. 4A to 4D are explanatory diagrams of an operation of the sheet loading device, wherein FIGS. 4A and 48 are, respectively, a bottom view and a sectional view of the sheet loading device in a state when each of a pair of side-fence members is set at a position where they are located in closest relation to each other, and FIGS. 4C and 4D are, respectively, a bottom view and a sectional view of the sheet loading device in a state after each of the pair of side-fence members is moved at a given position within a movable range.

FIGS. 5A and 5B show an image forming apparatus using the sheet loading device, wherein FIG. 5A is an explanatory front sectional view schematically showing an internal structure of the image forming apparatus, and FIG. 5B is an exterior perspective view of the image forming apparatus.

DESCRIPTION OF THE PREFERRED EMBODIMENTS

Figure 1:
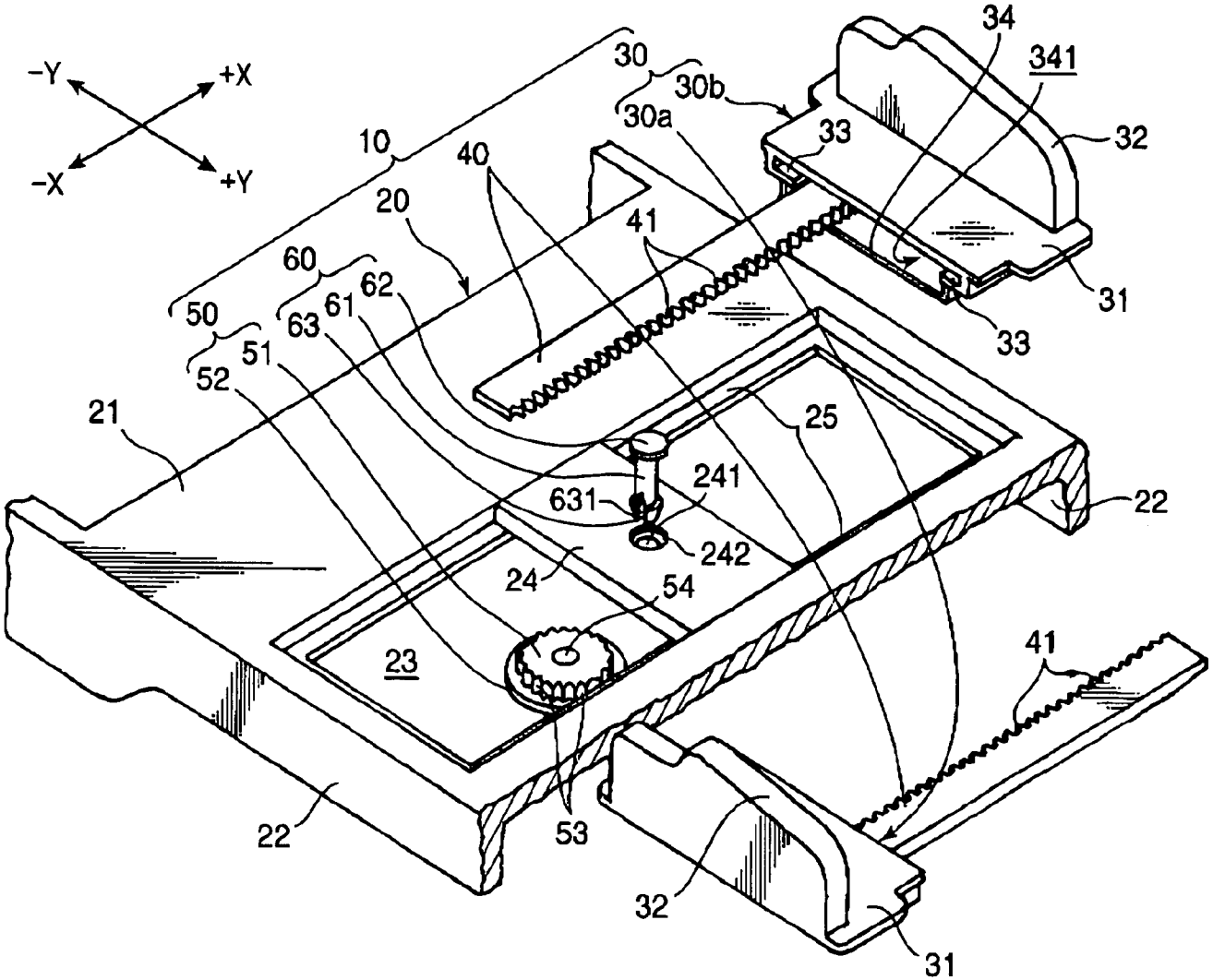
FIG. 1 is an exploded perspective view showing a sheet loading device according to one embodiment of the present invention.
Figure 2:
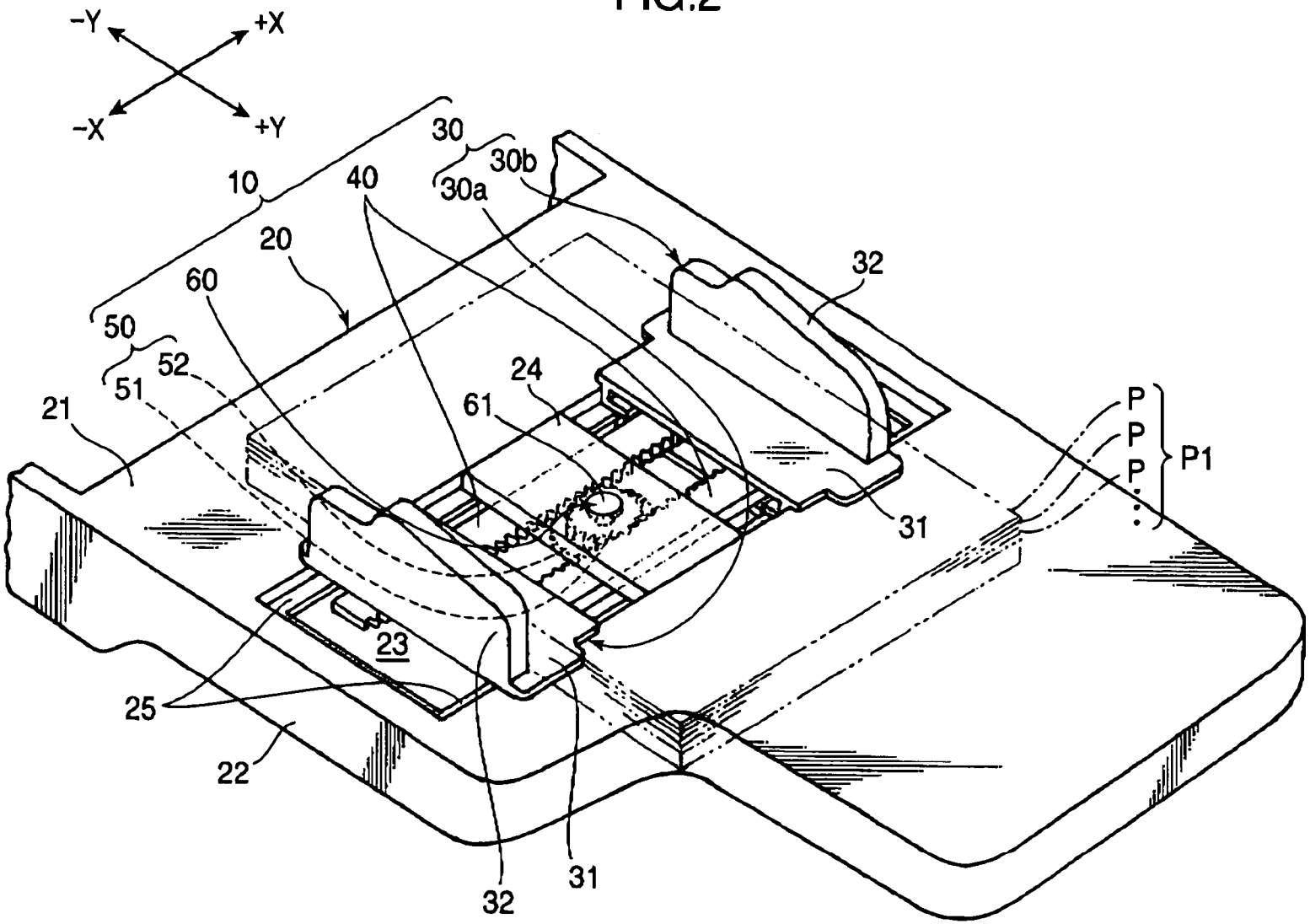
FIG. 2 is an assembled perspective view of the sheet loading device in FIG. 1.

FIG. 1 is an exploded perspective view showing a document loading device 10 according to one embodiment of the present invention, and FIG. 2 is an assembled perspective view of the document loading device 10. This document loading device 10 is applied to an automatic document feeder 152 (FIG. 5) which is combined with an image forming apparatus 100 (FIG. 5) to automatically load or feed a document to a read mechanism so as to read a document image on the document. In FIGS. 1 and 2, the X-X direction will be referred to as "lateral or width directions", and the Y-Y direction will be referred to as "longitudinal direction". Further, the −X direction and the +X direction will be referred to respectively as "leftward" and "rightward", and −Y direction and the +Y direction will be referred to respectively as "frontward" and "rearward".

As shown in FIG. 1, a document loading device 10 has a basic structure comprising a document tray (sheet tray) 20, a pair of side-fence members 30, a pair of racks 40, a pinion member 50, a pinion shaft 60.

The document tray 20 is adapted to place thereon a document stack (sheet stack) P1 which consists of a plurality of stacked documents (sheets) P (FIG. 2) to be loaded toward a document read section of the image forming apparatus 100. The pair of side-fence members 30 is mounted to the document tray 20 movably in the lateral direction. The pair of racks 40 are attached to respective ones of the pair of side-fence members 30 to extend in mutually opposed directions of the side-fence members 30 (rightward and leftward directions). The pinion member 50 is interposed between the pair of racks 40 and adapted to transmit a movement of one of the racks 40 to the other rack 40. The pinion shaft 60 is used for mounting the pinion member so to the document tray 20.

The document tray 20 includes a flat plate-shaped tray body 21, and a pair of side plates 22 formed to protrude downwardly from respective right and left edges of the tray body 21, and extend in the longitudinal direction. The side plates 22 are inserted into a housing of the automatic document feeder 152 (FIG. 5) through a document loading opening of the housing, and fixed to the housing. In this state, the documents (sheets) P placed on the tray body 21 will be loaded toward the inside of the automatic document feeder 152 (FIG. 5).

The tray body 21 has a central portion formed with a rectangular-shaped mounting window 23 for mounting the side-fence members 30 to the tray body 21 in a movable manner. The mounting window 23 has a laterally central region provided with a bridge plate 24 which extends longitudinally across the mounting window 23. The pinion member 50 is mounted on the side of a bottom surface of the bridge plate 24. The bridge plate 24 has a central portion formed with a through-hole 241 for mounting the pinion member 50 to the tray body 21.

A pair of front and rear guide rails 25 is formed along respective front and rear edges of the mounting window 23 to extend laterally at a position below the bridge plate 24. The pair of side-fence members 30 is adapted to be moved in the positive and negative lateral directions while being guided by the guide rails 25.

As shown in FIG. 2, the side-fence members 30 are operable to sandwich the document stack (sheet stack) P1 placed on the document tray 20, from right and left sides thereof, to uniform a lateral position of the document stack P1 and position the document stack P1 on the document tray 20. The side-fence members 30 consist of a left side-fence member 30*a* adapted to be brought into contact with a left edge of the document stack P1, and a right side-fence member 30*b* adapted to be brought into contact with a right edge of the document stack P1.

Figure 3:
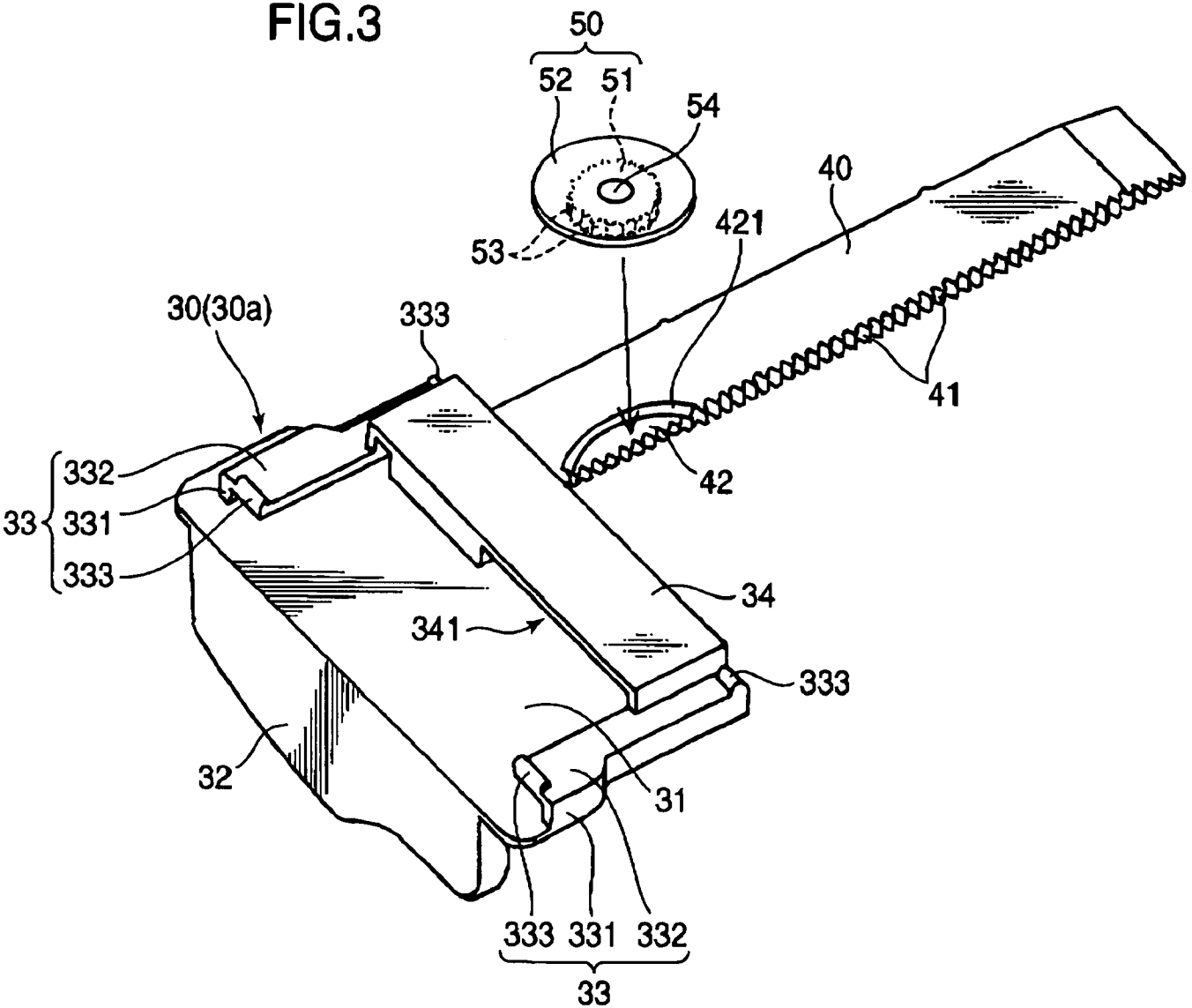
FIG. 3 is a perspective view showing a side-fence member in a state after being turned upside down to orient a bottom surface thereof upward.

FIG. 3 is a perspective view showing the side-fence member 30 in a state after being turned upside down to orient a bottom surface thereof upward. In FIG. 3, among the right and left side-fence members 30*b*, 30*a*, the right side-fence member 30*a* is illustrated as a representative example.

As shown in FIG. 3 and FIGS. 1 and 2, the side-fence member 30 includes a base plate 31, a side-fence wall 32, a pair of front and rear cushion piece 33, and a rack support member 34. The base plate 31 is adapted to place thereon the document stack P1. The side-fence wall 32 is formed to protrude upward from a laterally outward edge of the base plate 31 (a left edge when the side-fence member 30 is the left side-fence member 30*a*; a right edge when the side-fence member 30 is the right side-fence member 30*b*), and extend in the lateral direction. The pair of front and rear cushion pieces 33 is formed to protrude downward from respective ones of front and rear edge regions of a bottom surface of the base plate 31 and extend in the lateral direction. The rack support member 34 is formed to bridge between respective laterally inward portions of the pair of cushion pieces 33 (between respective right portions when the side-fence member 30 is the left side-fence member 30*a*; between respective left portions when the side-fence member 30 is the right side-fence member 30*b*) so as to support the rack 40 attached to the other side-fence member 30.

The base plate 31 has a longitudinal dimension slightly greater than that of the mounting window 23 of the document tray 20. Thus, in a state after the rack support member 34 is inserted into the mounting window 23, the base plate 31 is supported by the tray body 21, and the front and rear cushion pieces 33 are supported by the respective front and rear guide rails 25. This allows the side-fence member 30 to be mounted on the mounting window 23 in a laterally movable manner.

In this embodiment, the side-fence wall 32 has a longitudinal dimension approximately equal to that of the base plate 31. Alternatively, the side-fence wall 32 may have a longitudinal dimension greater or less than that of the base plate 31.

Each of the cushion pieces 33 has a vertical portion 331 which protrudes downward from each of the front and rear edge regions of the bottom surface of the base plate 31 and extends in the lateral direction, and a horizontal portion 332 which protrudes from a lower edge of the vertical portion 331 in one of mutually opposed directions of the cushion pieces 33 and extends in the lateral direction. That is, the cushion piece 33 has an L shape in side view. Thus, the horizontal portion 332 can be elastically deformed toward the base plate 31 to obtain a cushioning effect.

Further, each of the cushion pieces 33 is formed with two contact protrusions 333 which protrude downward from respective right and left ends of the horizontal portion 332 and extend in the longitudinal direction. Thus, in a state after the side-fence member 30 is inserted into the mounting window 23, the protrusions 333 are in contact with the guide rails 25 to reduce a contact area between the side-fence member 30 and the guide rails 25. This makes it possible to smoothly perform a movement of the side-fence member 30 guided by the guide rails 25.

The rack support member 34 is formed to bridge between the respective horizontal portions 332 of the pair of cushion pieces 33. Thus, a rack penetration space 341 is defined between the rack support member 34 and the base plate 31, to allow the rack 40 attached to the other side-fence member 30 to penetrate therethrough. In this manner, the rack 40 attached to one of the pair of side-fence members 30 can be inserted through the rack penetration space 341 of the other side-fence members 30 to effectively prevent occurrence of an undesirable situation where a distal end of the rack 40 is inclined downwardly by gravity.

The racks 40 are attached to respective ones of the right and left side-fence members 30*b*, 30*a* to protrude in the mutually opposed direction of the side-fence members 30. Specifically, the rack 40 protruding from the left side-fence member 30*a* has a left end which is fixedly clamped between a rearward portion of the base plate 31 and the rack support member 34, and protrudes rightwardly from the fixed left end. Correspondingly, the rack 40 protruding from the right side-fence member 30*b* has a right end which is fixedly clamped between a frontward portion of the base plate 31 and the rack support member 34, and protrudes leftwardly from the fixed right end. Thus, as shown in FIG. 2, in a state after the right and left side-fence members 30*b*, 30*a* are mounted on the mounting window 23, the racks 40 are located in longitudinally opposed relation to each other while being offset from each other in the lateral direction.

A row of rack teeth 41 are formed in each of opposed edges of the pair of racks 40. In a state after the right and left side-fence members 30*b* and 30*a* are mounted on the mounting window 23, the respective rows of rack teeth 41 are engaged with the pinion member 50. Thus, for example, when the left side-fence member 30*a* is moved in the lateral direction, this movement is transmitted from the rack teeth 41 of the rack 40 fixed to the left side-fence member 30*a* to the rack teeth 41 of the rack 40 fixed to the right side-fence member 30*b* through the pinion member 50. As the result, the right side-fence member 30*b* is moved in a direction opposite to that of the movement of the left side-fence member 30*a* by a distance equal to that of the movement of the left side-fence member 30*a*.

The pinion member 50 has a pinion 51 engageable with the rack teeth 41 of the racks 40, and a flange 52 fixedly laminated onto one surface of the pinion 51 in a-coaxial manner. The pinion 51 has a diameter dimension allowing for engagement with the rows of rack teeth of the pair of racks 40 in the state after the right and left side-fence members 30*b* and 30*a* are mounted on the mounting window 23 of the document tray 20. The pinion 51 has a thickness dimension slightly less than that of the rack 40. The pinion member 50 has a center hole 54 formed at a center thereof to allow the pinion shaft 60 to be inserted therethrough.

The flange 52 has an outer diameter dimension greater than that of the engaged portion of the pinion 51 to fully cover pinion teeth 53. Thus, in a state after the right and left side-fence members 30*b* and 30*a* are mounted on the mounting window 23 of the tray body 21, and the pinion teeth 53 of the pinion 51 are engaged with the rows of rack teeth 41 of the racks 40, the flange 52 covers a part of the rack teeth 41 of the racks 40. Thus, each of the racks 40 is pinched between the flange 52 and the bridge plate 24. A frictional force produced between these components provides stable positioning of the side-fence members 30 (see FIG. 4D).

As shown in FIG. 1, the pinion shaft 60 includes a columnar-shaped shaft body 61, a flat circular-shaped head 62 coaxially formed at an upper end of the shaft body 61, and a pair of fork-shaped hooks 63 formed at a lower end of the shaft body 61 to extend in an axial direction thereof. The shaft body 61 has a length dimension (a dimension between the head 62 and the hooks 63; a dimension which defines a fit dimension of the present invention) which is slightly less than a sum of respective thickness dimensions of the rack 40 and the bridge plate 24. Thus, the pinion shaft 60 is elastically deformed to allow each of the racks 40 to be strongly pressed and pinched between the flange 52 and the bridge plate 24. A frictional force produced between these components can provide stable positioning of the side-fence walls 32.

The hooks 63 have a fork shape with two legs which are formed on both sides of a center groove 631 extending upward from a lower end thereof along an axis of the shaft body 61. The hooks 63 are formed in a taper shape which has an upper end with a diameter dimension slightly greater than that of the shaft body 61, and a lower end with a diameter dimension slightly less than that of the shaft body 61. Thus, in an operation of sequentially inserting the pinion shaft 60 through the through-hole 241 of the bridge plate 24 and the center hole 54 of the pinion member 50, the pair of hooks 63 are elastically deformed when passing through the through-hole 241 in such a manner that they are moved closer to each other through the center groove 631. Then, after passing through the center hole 54 in the same state, the hooks 63 protrude out of the center hole 54 and return to their original positions to establish a retained state.

The bridge plate 24 has an edge hole 242 formed around an upper end of the through-hole 241 to have a diameter dimension slightly greater than the head 62 of the pinion shaft 60. Thus, in a state after the shaft body 61 is inserted through the through-hole 241, the head 62 is fitted into the edge hole 242 so as to allow respective top surfaces of the head 62 and the bridge plate 24 to be flush with each other.

As shown in FIG. 3, in this embodiment, an arc concave portion (concave portion) 42 is concavedly formed in a bottom surface (which is illustrated as a surface oriented upward in FIG. 3) of an anchor end (an end on the side of the associated side-fence member 30) of each of the racks 40, in such a manner as to define a circular space to allow the flange 52 to be fitted thereinto when each of the pair of side-fence members 30 is set at a position where they are located in closest relation to each other (see FIG. 4A) (hereinafter referred to as "closest position"). A distance between the pair of side-fence members 30 in the state when the pair of side-fence members 30 are set at their closest positions is made less than a minimum width dimension of the sheets. The arc concave portion 42 is formed in a circular arc shape which has a curvature center on the axis of the pinion shaft 60, and a diameter dimension greater than an outer diameter dimension of the flange 52. In this embodiment, the arc concave portion 42 is formed to have a depth of 0.5 mm, Alternatively, instead of 0.5 mm, the depth of the arc concave portion 42 may be less than 0.5 mm (e.g., 0.4 mm, 0.3 mm, 0.2 mm or 0.1 mm) or may be greater than 0.5 mm (e.g., 0.6 mm, 0.7 mm, 0.8 mm, 0.9 mm or 1.0 mm).

Each of the racks 40 also has an inclined edge portion 421 which is formed around a peripheral edge of the arc concave portion 42 to extend inclinedly and upwardly from the bottom surface of the rack 40 to the peripheral edge of the arc concave portion 42.

As above, the arc concave portion 42 is concavedly formed in the bottom surface of each of the racks 40. Thus, in an operation of mounting the pinion member 50 to the bridge plate 24 in a state after the right and left side-fence members 30*b* and 30*a* are set at their closest positions, the flange 52 of the pinion member 50 is fitted into the respective arc concaved portions 42 of the racks 40. This makes it possible to facilitate the operation of inserting the pinion shaft 60 through the through-hole 241 of the bridge plate 24 and the center hole 54 of the pinion member 50 during assembling of the pinion member 50.

In the above manner, all of the right and left side-fence members 30*b* and 30*a*, the pair of racks 40 and the pinion member 50 are mounted to the tray body 21 to provide the document loading device 10 as shown in FIG. 2. FIG. 2 illustrates a state after each of the right and left side-fence members 30*b* and 30*a* is moved to a position slightly away from the closest position.

Figures 4A, 4B, 4C, 4D:
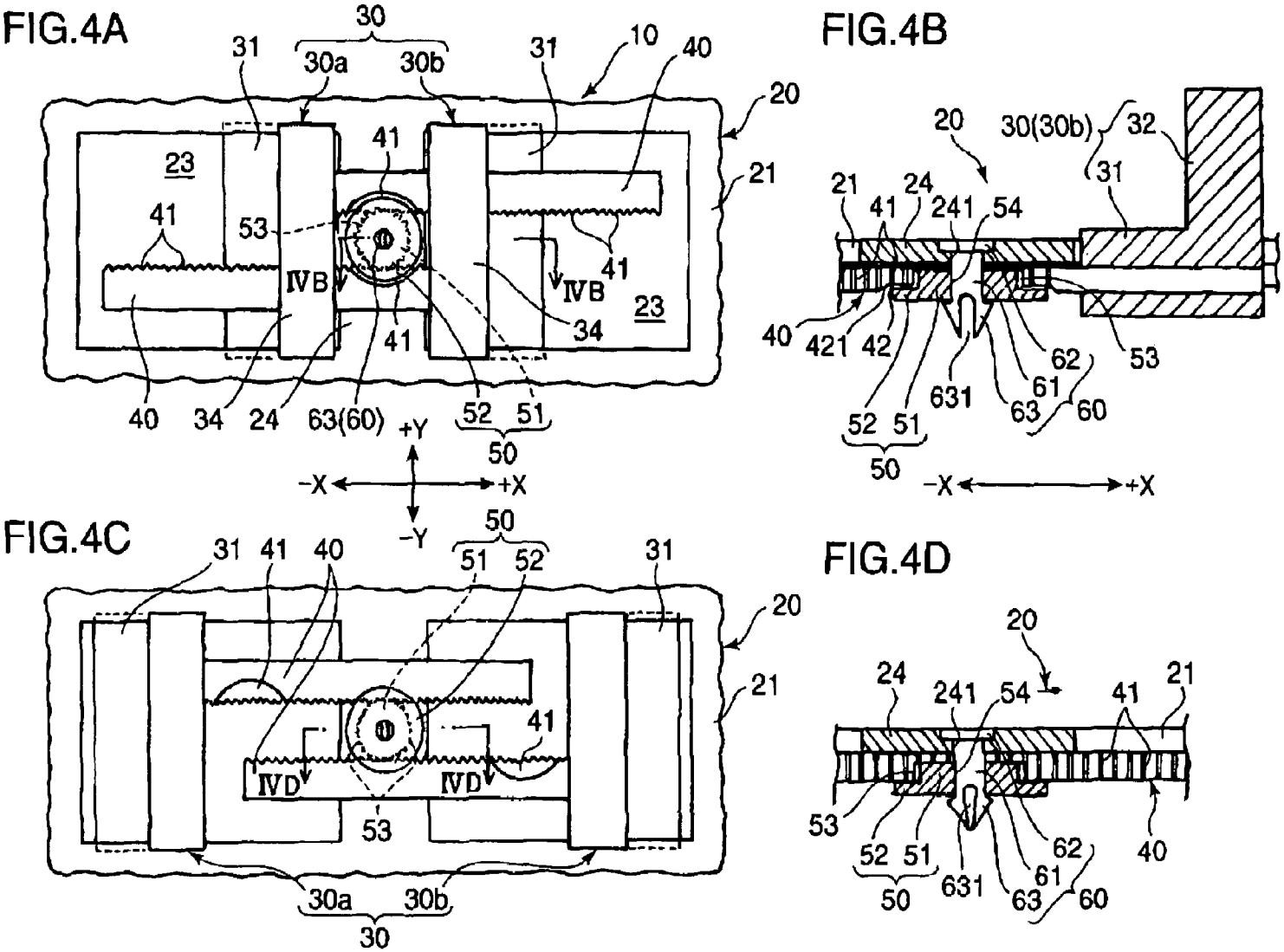

An operation of the document loading device 10 will be described based on FIGS. 4A to 4D. FIGS. 4A to 4D are explanatory diagrams of the operation of the document loading device 10. FIG. 4A is a bottom view of the document loading device 10 in the state when the pair of side-fence members are located at their closest positions, and FIG. 4B is a sectional view taken along the line IVB-IVB in FIG. 4A. FIG. 4C is a bottom view of the document loading device 10 in the state after the pair of side-fence members are moved to given positions within a movable range, and FIG. 4D is a sectional view taken along the line IVD-IVD in FIG. 4C. As with FIG. 1, the X and Y directions in FIGS. 4A to 4D are defined as follows: X indicates "lateral direction" (−X; "leftward", +X: "rightward"), and Y indicates "longitudinal direction" (−Y: "frontward", +Y: "rearward").

As shown in FIG. 4A, in the state when the side-fence members 30 are set at their closest positions, the flange 52 of the pinion member 50 is fitted into the arc concave portions 42 of the racks 40. Thus, the pinion member 50 has a given vertical play. It will be seen that because the distance between the pair of side-fence members 30 in the state when they are set at their closest positions is less than a minimum width dimension of the sheets, an operation of moving the side-fence members 30 up to their closest position is never used for registering a lateral position of the sheets in the state of having a wobbling movement. Then, when either one of the side-fence members 30 (e.g., the left side-fence member 30*a*) is moved in a direction (e.g., leftwardly) away from the other side-fence member 30 (e.g. the right side-fence member 30*b*), this movement is transmitted to the pinion 51 through the rack 40 fixed to the left side-fence member 30*a* to rotate the pinion 51 counterclockwise about the pinion shaft 60. According to this rotation, the rack 40 fixed to the right side-fence member 30*b* is moved rightwardly by the same distance, as shown in FIG. 4C.

When the right side-fence member 30*b* is moved rightwardly in the state when the flange 52 of the pinion member 50 is fitted into the arc concave portions 42 of the racks 40 (FIG. 4B), the flange 52 of the pinion member 50 is moved downwardly along and relative to the inclined edge portions 421 of the arc concave portions 42 to get out of the arc concave portions 42.

As shown in FIG. 4D, in a state after the flange 52 is moved completely out of the arc concave portions 42, the pinion member 50 is spaced apart from the bridge plate 24 with an elastic deformation of the pinion shaft 60 (FIG. 4D shows one example where the hooks 63 are elastically deformed), and thereby the racks 40 are pressed and pinched between the flange 52 and the bridge plate 24. Thus an appropriate frictional force acts between pinion member 50 and each of the racks 40 to prevent a distance between the pair of side-fence members 30 set in conformity to a size of a document P from be lightly changed.

As mentioned above in detail, the document loading device 10 according to this embodiment for use with the image forming apparatus 100 comprises the document tray 20 adapted to place thereon a document stack P1 consisting of a plurality of stacked documents P to be loaded to a given apparatus, the pair of side-fence members 30 disposed on the side on the top surface of the document tray 20 to sandwich the document stack P1 therebetween in a direction orthogonal to a document feed direction, the pair of racks 40 attached to respective ones of the side-fence members and disposed on the side of the bottom surface of the document tray 20 to extend in mutually opposed directions of the side-fence members 30, and the pinion 51 adapted to be rotated about the pinion shaft 60 penetrating the document tray 20 and engaged with the racks 40. When a first one of the side-fence members 30 is moved in the lateral direction (width direction of the document), this movement is transmitted to the other or second side-fence member 30 through the rack 40 attached to the first side-fence member 30, the pinion 51 and the rack 40 attached to the second side-fence member 30. Thus, the second side-fence member 30 is moved in a direction opposite to that of the movement of the first side-fence member 30 by a distance equal to that of the movement of the first side-fence member 30. This makes it possible to position the documents P on the document tray 20 in conformity to a size of the documents P without changing a position of a center line of the documents P in the document loading direction.

Further, the pinion has a first surface opposite to the bottom surface of the document tray 20, and a second surface located on the opposite side of the first surface and provided coaxially and integrally with the flange 52 having a diameter greater than that of an engaged portion of the pinion 51. Thus, the pair of racks 40 located on the side of the bottom surface of the document tray 20 are pinched between the flange 52 and the document tray 20 while being engaged with the pinion 51. An appropriate resistance based on a frictional force produced between these components allows the pair of side-fence members 30 to be stably positioned.

Furthermore, each of the racks 40 has the arc concave portion 42 which is concavedly formed in the bottom surface of an end thereof on the side of the associated side-fence member 30 to have a curvature center on the axis of the pinion shaft 60 and a diameter dimension greater than the outer diameter dimension of the flange 52 when the pair of side-fence members 30 are set at their closest positions. Thus, in the operation of mounting the pair of side-fence members 30 to the document tray 20, the pair of side-fence members 30 are temporarily attached to their mounting locations in the document tray 20 and disposed at their closest positions, and then the pinion 51 is engaged with the racks 40 located on the side of the bottom surface of the document tray 20. In this process, the flange 52 coaxially and integrally provided to the pinion 51 is fitted into the arc concave portions 42 formed in the racks 40. This makes it possible to reliably fix a relative position to each of the racks 40 so as to facilitate the operation of assembling the pinion 51 and the side-fence members 30 having the racks 40 together.

Similarly. In maintenance of the document loading device, the contact state between the flange 52 and each of the racks 40 can be loosened by fitting the flange 52 into the arc concave portions 42 so as to facilitate an operation of detaching and re-attaching the racks 40 and the pinion member 50.

The pinion shaft 60 comprises a member adapted to be elastically deformed during a transition from a first state in which the flange 52 is fitted in the arc concave portions 42, to a second state in which the flange 52 is out of the arc concave portion 42, so as to allow the pinion member 50 to be moved in a stretching direction of the pinion shaft 60. If the pinion member 50 is retained to the pinion shaft 60 by screwing, crimping, engagement or the like, the pinion member 50 fitted in the arc concave portion 42 will have difficulty in being moved out of the arc concave portion 42. The elastically-deformable pinion shaft 60 allows the pinion member 50 to be smoothly moved out of the arc concave portion 42.

Further, after the pinion member 50 is relatively moved out of the arc concave portion 42, the racks will be pressed between the flange 52 and the document tray 20 by the elastic force of the pinion shaft 60. The resulting frictional force prevents the pair of side-fence members 30 from being lightly moved so as to reliably maintain a distance between the side-fence members 30 set once in conformity to the size of the documents P.

In this embodiment, the pinion shaft 60 includes the shaft body 61, the head 62 provided at one end of the shaft body 61, and the pair of fork-shaped hooks 63 provided at the other end of the shaft body 61 to extend in the axial direction thereof. Thus, in the operation of fitting the pinion 51 into the arc concave portions of the racks 40 when each of the racks 40 is set at a position corresponding to the closest position, an then inserting the fork-shaped hooks 63 of the pinion shaft 60 through the respective through-holes of the document tray 20 and the pinion 51, the fork-shaped hooks 63 pass through the through-holes while being elastically deformed, and return to the original fork shape when they get out of the through-hole of the pinion 51 in such a manner as to be engaged with a peripheral edge of the through-hole of the pinion 51. In this manner, the pinion shaft 60 allows the pinion 51 to be mounted to the document tray 20 in the retained state. Thus, the pinion 51 can be mounted to the document tray 20 using the pinion shaft 60 by a single operation of inserting the pinion shaft 60 through the document tray 20 and the pinion 51, so as to improve the efficiency of the assembling operation.

The shaft body 61 of the pinion shaft 60 is formed to have a length dimension which allows a given gap to be defined between an inside (upper) surface of the arc concave portion 42 and a top surface of the flange 52 in the state when the flange 52 is fitted in the arc concave portions 42, and allows the bridge plate 24, each of the racks 40 and the flange 52 to be pressed into close contact with each other in the state after the flange 52 gets out of the arc concave portions 42 in conjunction with a positional change of the side-fence members 30. Thus, when the side-fence members 30 are moved in the state after the pinion 51 fitted in the arc concave portions 42 of the racks 40 is mounted to the document tray 20, the pinion 51 is relatively moved out of the arc concave portions 42 according to an elastic deformation of the hooks 63. The resulting increased frictional force to the flange 52 makes it possible to prevent the positioned side-fence members 30 from being lightly moved.

An outline of the image forming apparatus 100 as a copy machine, using the document loading device 10 described in the above embodiment, will be described below.

Figure 5B:
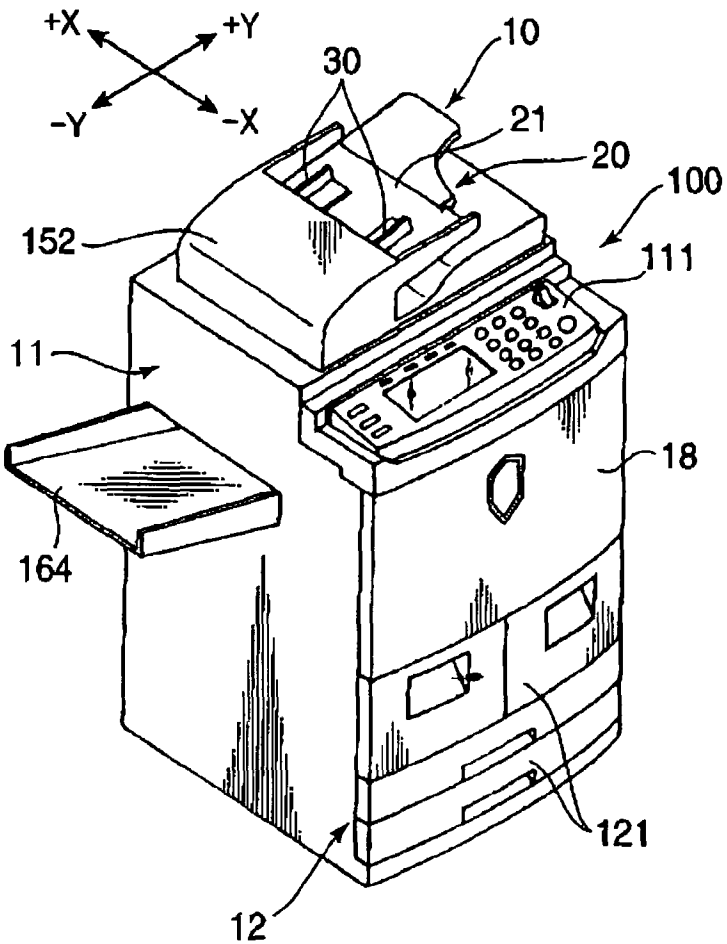
Figure 5A:
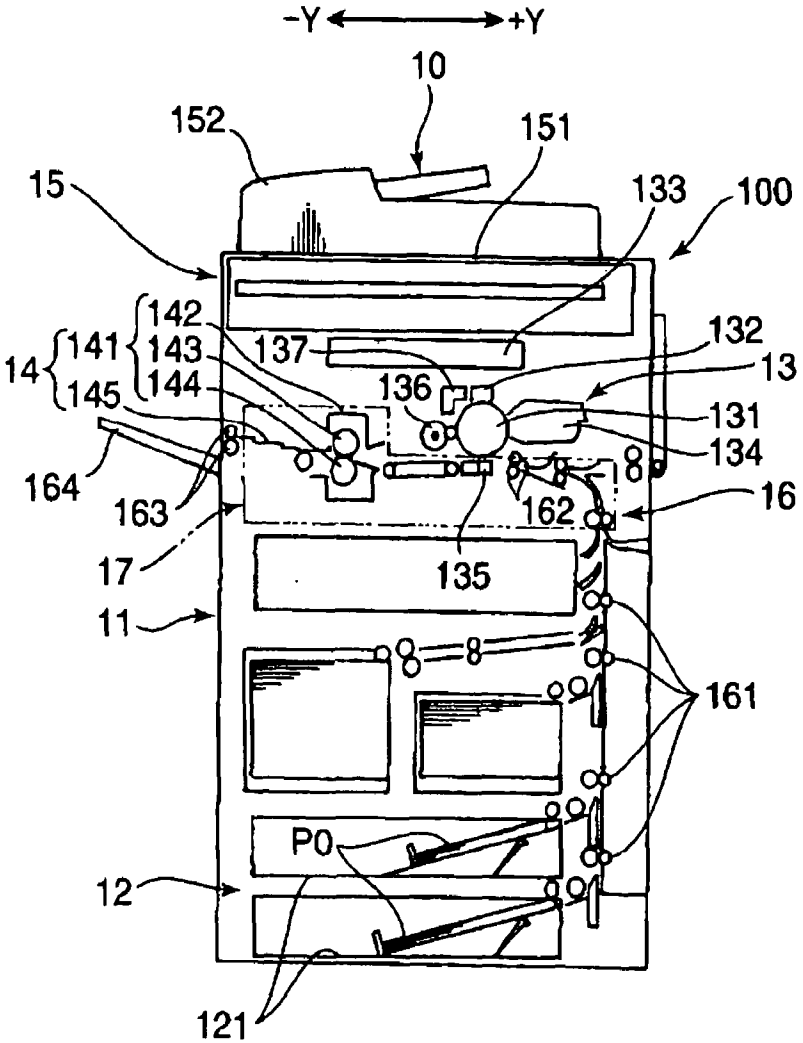

FIGS. 5A and 5B show the image forming apparatus 100 using the above document loading device 10, according to one embodiment of the present invention, wherein FIG. 5A is an explanatory front sectional view schematically showing an internal structure of the image forming apparatus 100, and FIG. 5B is an exterior perspective view of the image forming apparatus 100. As with FIG. 1, the X and Y directions in FIG. 5B are defined as follows: X indicates "lateral direction" (−X: "leftward", +X: "rightward"), and Y indicates "longitudinal direction" (−Y; "frontward", +Y: "rearward").

As shown in FIG. 5A, this embodiment will be described by taking a copy machine as one example of the image forming apparatus 100. The image forming apparatus 100 comprises a recording paper supply section 12 disposed in a lower portion of a box-shaped apparatus body (housing) 11, an image forming section 13 disposed above the recording paper supply section 12, a fixing section 14 disposed on a left side (in FIG. 5A) of the image forming section 13, an image reading section 15 disposed above the image forming section 13 and the fixing section 14 and provided with an optical component, and a sheet transport section 16 extending from the recording paper supply section 12 to a sheet ejection region via the image forming section 13 and the fixing section 14.

The image reading section 15 is operable to emit light from an exposure lump (not shown) onto a document placed on a contact glass 151, and lead a resulting reflected light to a photoelectric conversion device through a reflector to read image information. This image information is transmitted to an after-mentioned exposure unit 133.

The recording paper supply section 12 is operable to feed a stack of recording paper P0 stored in a recording paper cassette 121, to the recording paper transport section 16. The recording paper transport section 16 is operable to transport a recording paper P fed from the recording paper supply section 12, toward the image forming section 13 by a transport roller pair 16 and a registration roller pair 162, and, after passing through the image forming section 13 and the fixing section 14, eject the recording paper P0 onto a catch tray 164 attached to an outer wall of the apparatus body 11 by driving of an ejection roller pair 163.

The image forming section 13 is operable to transfer a given toner image onto the recording paper P0 through an electrophotographic process. The image forming section 13 comprises a photosensitive drum 131 adapted to be rotated about an axis thereof, and a plurality of other components including an electrostatic charger unit 132, an exposure unit 133, a development unit 134, a transfer unit 135, a cleaner 136 and a charge removal unit 137, which are disposed around the photosensitive drum 131 along the rotation direction thereof.

The charger unit 132 is operable to provide a given potential onto a surface of the photosensitive drum 131 by colonna discharge. The exposure unit 133 is operable to emit a laser light onto the photosensitive drum 131 based on document image data read by the image reading section 15 so as to selectively lower a potential of the surface of the photosensitive drum 131 to form an electrostatic latent image on the surface of the photosensitive drum 131. The development unit 134 is operable to develop the electrostatic latent image using toner particles so as to form a toner image on the surface of the photosensitive drum 131. The transfer unit 135 is operable to transfer the toner image on the surface of the photosensitive drum 131 to the recording paper P0. The cleaner 136 is operable to remove toner remaining on the surface of the photosensitive drum 131. The charge removal unit 137 is operable to remove charges remaining on the surface of the photosensitive drum 131.

The fixing section 14 is operable to perform a processing of fixing the toner image transferred onto the recording paper P0 in the image forming section 13. The fixing section 14 includes a fixing device 141 disposed on a downstream side of the image forming section 13 in the recording paper transport direction, and a cover unit 145 disposed on the downstream side of fixing device 141 to guide the recording paper P0 discharged from the fixing device 141, toward the ejection roller pair 163. The fixing device 141 includes a box-shaped fixing device body 142, a heating roller 143 supported by the fixing device body 142 rotatably about an axis thereof, and a pressing roller 144 in press contact with an outer peripheral surface of the heating roller 143.

The recording paper P0 transported from the image forming section 13 is transported according to rotations of the heating and pressing rollers 143, 144 while being pressed and nipped by a nip zone defined between the heating and pressing rollers 143. 144. During this process, the recording paper P0 is subjected total fixing processing of the toner image based on heat obtained from the heating roller 143. Then, the recording paper P0 is ejected toward the catch tray 164 through the cover unit 145 and the ejection roller pair 163.

In this embodiment, the image forming apparatus 100 includes a recording paper transport unit 17 adapted to be inserted into a region of the apparatus body 11 indicated by the two-dot chain line in FIG. 5A, which includes the registration roller pair 162, the ejection roller pair 163 and the fixing section 14, and primarily comprises the recording paper transport section 16. The reason for detachably providing such a recording paper transport unit 17 to the apparatus body 11 is to facilitate an operation for solving a jam and various maintenance operations based on the recording paper transport unit 17 designed to be drawn out of the apparatus body 11.

Further, as shown in FIG. 5B, in the image forming apparatus 100, the recording paper supply section 12 having a plurality of recording paper cassettes 121 is provided in the lower portion of the vertically-long rectangular parallelepiped-shaped apparatus body 11. In such a manner as to be drawn out in a leftward direction. The recording paper transport unit 17 including the fixing section 14 and the recording paper transport section 16 is internally attached immediately above the recording paper supply section 12, and the image forming section 13 is incorporated above the recording paper transport unit 17.

A manual operation panel 111 including a display board with a numeric keypad and a crystal display, and various types of operation keys, are provided in a left region of a top plate of the apparatus body 11. The automatic document feeder 152 is mounted on a right region of the top plate in a swingable manner to openably cover the contact glass 151. The aforementioned document loading device 10 is attached to the automatic document feeder 152.

A horizontally-openable cover 18 is provided in a left side surface of the apparatus body 11 above the recording paper supply section 12. As shown in FIG. 5B, this cover 18 is usually closed, and opened rearwardly during an operation for solving a jam and various maintenance operations.

The aforementioned document loading device 10 is suitably applied to the above the image forming apparatus 100.

The present invention is not limited to the above embodiments. For example, the present invention is intended to include the following modifications.

(1) In the above embodiments, a copy machine has been shown as one example of an image forming apparatus 100 using the document loading derive 10 of the present invention. The document loading derive 10 of the present invention is not limited to such an application, but may be applied to a facsimile machine, a printer and a scanner. Further, the document loading derive 10 of the present invention may be applied to any other suitable apparatus, such as various types of press machines, handling a sheet.

(2) In the above embodiments, the pinion shaft 60 has been employed as a member to be mounted to the bridge plate 24. Alternatively, the bridge plate 24 may have a protrusion formed to protrude downwardly in place of the pinion shaft 60, and may be inserted into the pinion member 50.

(3) In the above embodiments, the arc concave portion 42 with a circular arc shape has been employed as a concave portion to be formed in each of the racks 40. Alternatively, the concave portion may have any other suitable shape, such as a rectangular shape, a polygonal shape or an elliptical shape, allowing the flange 52 to be fitted thereinto.

The above embodiments primarily include the following inventions.

A sheet loading device according to a first aspect of the invention comprises a sheet tray adapted to place thereon a sheet stack consisting of a plurality of stacked sheets, a pair of side fences disposed on the side on a top surface of the sheet tray to sandwich the sheet stack therebetween in a direction orthogonal to a sheet loading direction, a pair of racks attached to respective ones of the pair of side fences and disposed on the side of a bottom surface of the sheet tray to extend in mutually opposed directions of the pair of side fences, and a pinion adapted to be rotated about a pinion shaft penetrating the sheet tray and engaged with the racks. The pinion has a first surface opposite to the bottom surface of the sheet tray, and a second surface located on the opposite side of the first surface and provided coaxially with a flange having a diameter greater than that of an engaged portion of the pinion. Each of the racks has a concave portion formed in a bottom surface of an end thereof on the side of the associated side fence and adapted to allow the flange to be fitted therein.

An image forming apparatus according a second aspect of the present invention comprises an apparatus body for reading image data from a sheet and performing an image forming processing based on said read image data, and a sheet loading device for loading a sheet as a read target to said apparatus body. The sheet loading device has the above features of the sheet loading device according to the first aspect of the present invention.

In the above sheet loading device and the image forming apparatus of the present invention, when a first one of the side fences is moved in a lateral direction (width direction of the sheet), this movement is transmitted to the other or second side fence through the rack attached to the first side fence, the pinion and the rack attached to the second side fence. Thus, the second side fence is moved in a direction opposite to that of the movement of the first side fence by a distance equal to that of the movement of the first side fence. This makes it possible to position the sheets on the sheet tray in conformity to a size of the sheets without changing a position of a center line of the sheets in the sheet loading direction.

The pinion has a first surface opposite to the bottom surface of the sheet tray, and a second surface which is located on the opposite side of the first surface and provided coaxially and integrally with the flange having a diameter greater than that of an engaged portion of the pinion. Thus, the pair of racks located on the side of the bottom surface of the sheet tray are pinched between the flange and the sheet tray while being engaged with the pinion. An appropriate resistance based on a frictional force produced between these components allows the pair of side fences to be stably positioned.

Further, each of the racks has the concave portion which is concavedly formed in the bottom surface of an end thereof on the side of the associated side fence. Thus, the contact state between the pinion and each of the racks can be loosened by fitting the flange into the concave portions, so as to facilitate an operation of attaching and detaching the racks and the pinion.

In a state after the pinion is moved relative to and out of the concave portion, each of the racks is pressed against the sheet tray by the flange, and thereby a frictional force is increased to prevent the side fences from being moved. This makes it possible to reliably maintain a distance between the side fences set once.

In the above sheet loading device and the image forming apparatus of the present invention, the pinion shaft preferably comprises a member adapted to be elastically deformed during a transition from a first state in which the flange of the pinion is fitted in the concave portion, to a second state in which the flange is out of the concave portion, so as to allow the pinion to be moved in a stretching direction of the pinion shaft.

Specifically, the pinion shaft may include a shaft body, a head provided at one end of the shaft body, and a pair of fork-shaped hooks provided at the other end of the shaft body to extend in an axial direction thereof.

According to the above feature, in the operation of fitting the pinion into the concave portions of the racks when each of the racks is set at a position corresponding to the closest position, an then inserting the fork-shaped hooks of the pinion shaft through the respective through-holes of the sheet tray and the pinion, the fork-shaped hooks pass through the through-holes while being elastically deformed, and return to the original fork shape when they get out of the through-hole of the pinion in such a manner as to be engaged with a peripheral edge of the through-hole of the pinion. In this manner, the pinion shaft allows the pinion to be mounted to the sheet tray in a retained state. Thus, the pinion can be mounted to the sheet tray using the pinion shaft by a single operation of inserting the pinion shaft through the sheet tray and the pinion, so as to improve the efficiency of the assembling operation.

In this case, the shaft body is preferably formed to provide a fit dimension which allows a given gap to be defined between respective opposed surfaces of the concaved portion and the flange during the first state in which the flange of the pinion is fitted in the concave portion, and allows the sheet tray, each of the tacks and the flange to be pressed into close contact with each other during the second state in which the flange is out of the concave portion due to a positional change of the side fences.

The gap produced by the above fit dimension can facilitate an operation of positioning the racks to allow the concave portions to be aligned with a given position of the sheet tray and then inserting the pinion shaft through the pinion, so as to mount the pinion to the sheet tray through the racks.

In the state after the flange is moved out of the concave portion due to a positional change of the side fences, the fit dimension defined by the shaft body allows each of the racks and the flange to be pressed into close contact with each other. Thus, a frictional force produced between these three components can effectively prevent the racks from being lightly moved.

In the above sheet loading device and the image forming apparatus of the present invention, the concave portion is preferably formed in a circular arc shape. In this case, a circular arc concave portion of one of the pair of racks is preferably made to face a circular arc concave portion of the other rack in the state when the pair of side fences are positioned in closest relation to each other to define a circular space to allow the flange to be fitted therein.

According to this feature, in the operation of mounting the pair of side fences to the sheet tray, the pair of side fences are temporarily attached to their mounting locations in the sheet tray and disposed at their closest positions, and then the pinion is engaged with the racks located on the side of the bottom surface of the sheet tray. In this process, the flange coaxially and integrally provided to the pinion is fitted into the arc concave portions formed in the racks. This makes it possible to reliably fix a relative position to each of the racks so as to facilitate the operation of assembling the pinion and the side fences having the racks together.

Further, the concave portions are formed in the bottom surfaces of the racks at positions opposed to the flange in the state when the pair of side fences are set at their closest positions. Thus, the side fences after being mounted to the sheet tray once is never moved to the closest positions. This makes it possible to prevent occurrence of an undesirable situation where the flanges of the pair of side fences are fitted into the concave portions during an actual operation of moving the side fences to sandwich sheets therebetween.

In the above sheet loading device and the image forming apparatus of the present invention, a distance between the pair of side fences in the state when the pair of side fences are set at their closest positions is preferably less than a minimum width dimension of the sheets.

According to this feature, an operation of moving the side fences up to their closest position is never used for registering a lateral position of the sheets. In the above the above sheet loading device and the image forming apparatus, a wobbling movement is purposefully provided to the side fences at the closest positions, and the wobbling movement of the side fences is suppressed at any position out of the closest positions, so as to satisfy both needs for providing improved efficiency of the assembling operation and enhanced usability after the assembling.

In addition, each of the arc concaved portions having a diameter dimension slightly greater than the outer diameter of the flange makes it possible to limit the wobbling movement of the side fences through the pinion to a necessity minimum level.

This application is based on patent application No. 2005-362805 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A sheet loading device comprising:

a sheet tray adapted to place thereon a sheet stack consisting of a plurality of stacked sheets;

a pair of side fences disposed on the side on a top surface of said sheet tray to sandwich said sheet stack therebetween in a direction orthogonal to a sheet loading direction;

a pair of racks attached to respective ones of said pair of side fences and disposed on the side of a bottom surface of said sheet tray to extend in mutually opposed directions of said pair of side fences; and a pinion adapted to be rotated about a pinion shaft penetrating said sheet tray and engaged with said racks, said pinion having a first surface opposite to the bottom surface of said sheet tray, and a second surface located on the opposite side of said first surface and provided coaxially with a flange having a diameter greater than that of an engaged portion of said pinion, wherein each of said racks has a concave portion formed in a bottom surface of an end thereof on the side of the associated side fence and adapted to allow said flange to be fitted therein.

2. The sheet loading device as defined in claim 1, wherein said pinion shaft comprises a member adapted to be elastically deformed during a transition from a first state in which the flange of said pinion is fitted in said concave portion, to a second state in which said flange is out of said concave portion, so as to allow said pinion to be moved in a stretching direction of said pinion shaft.

3. The sheet loading device as defined in claim 2, wherein said pinion shaft includes a shaft body, a head provided at one end of said shaft body, and a pair of fork-shaped hooks provided at the other end of said shaft body to extend in an axial direction thereof.

4. The sheet loading device as defined in claim 3, wherein said shaft body is formed to provide a fit dimension which allows a given gap to be defined between respective opposed surfaces of said concaved portion and said flange during said first state in which the flange of said flange is fitted in said concave portion, and allows said sheet tray, each of said racks and said flange to be pressed into close contact with each other during said second state in which said flange is out of said concave portion due to a positional change of said side fences.

5. The sheet loading device as defined in claim 1, wherein said concave portion is formed in a circular arc shape.

6. The sheet loading device as defined in claim 5, wherein a circular arc concave portion of one of said pair of racks faces a circular arc concave portion of the other rack in the state when said pair of side fences are positioned in closest relation to each other to define a circular space to allow said flange to be fitted therein.

7. The sheet loading device as defined in claim 6, wherein a distance between said pair of side fences in the state when said pair of side fences are set at their closest positions is less than a minimum width dimension of the sheets.

8. An image forming apparatus comprising:

an apparatus body for reading image data from a sheet and performing an image forming processing based on said read image data; and a sheet loading device for loading a sheet as a read target to said apparatus body, said sheet loading device including:

a sheet tray adapted to place thereon a sheet stack consisting of a plurality of stacked sheets;

a pair of side fences disposed on the side on a top surface of said sheet tray to sandwich said sheet stack therebetween in a direction orthogonal to a sheet loading direction;

a pair of racks attached to respective ones of said pair of side fences and disposed on the side of a bottom surface of said sheet tray to extend in mutually opposed directions of said pair of side fences; and a pinion adapted to be rotated about a pinion shaft penetrating said sheet tray and engaged with said racks, said pinion having a first surface opposite to the bottom surface of said sheet tray, and a second surface located on the opposite side of said first surface and provided coaxially with a flange having a diameter greater than that of an engaged portion of said pinion, wherein each of said racks has a concave portion formed in a bottom surface of an end thereof on the side of the associated side fence and adapted to allow said flange to be fitted therein.

9. The image forming apparatus as defined in claim 8, wherein said pinion shaft comprises a member adapted to be elastically deformed during a transition from a first state in which the flange of said pinion is fitted in said concave portion, to a second state in which said flange is out of said concave portion, so as to allow said pinion to be moved in a stretching direction of said pinion shaft.

10. The image forming apparatus as defined in claim 9, wherein said pinion shaft includes a shaft body, a head formed at one end of said shaft body, and a pair of fork-shaped hooks formed at the other end of said shaft body to extend in an axial direction thereof.

11. The image forming apparatus as defined in claim 10, wherein said shaft body is formed to provide a fit dimension which allows a given gap to be defined between respective opposed surfaces of said concaved portion and said flange during said first state in which said flange is fitted in said concave portion, and allows said sheet tray, each of said racks and said flange to be pressed into close contact with each other during said second state in which said flange is out of said concave portion due to a positional change of said side fences.

12. The image forming apparatus as defined in claim 8, wherein said concave portion is formed in a circular arc shape.

13. The Image forming apparatus as defined in claim 12, wherein a circular arc concave portion of one of said pair of racks faces a circular arc concave portion of the other rack in the state when said pair of side fences are positioned in closest relation to each other to define a circular space to allow said flange to be fitted therein.

14. The image forming apparatus as defined in claim 13, wherein a distance between said pair of side fences in the state when said pair of side fences are set at their closest positions is less than a minimum width dimension of the sheets.

* * * * *